United States Patent [19]

Adams et al.

[11] Patent Number: 4,971,566

[45] Date of Patent: Nov. 20, 1990

[54] PRINTED WIRING BOARD CONNECTOR

[75] Inventors: John T. Adams, Minneapolis; Rolf L. Strand, Crystal, both of Minn.

[73] Assignee: Honeywell Inc., Minneapolis, Minn.

[21] Appl. No.: 266,730

[22] Filed: Nov. 3, 1988

[51] Int. Cl.[5] ..... H01R 9/09

[52] U.S. Cl. ..... 439/80; 439/849

[58] Field of Search ..... 439/78, 79, 80, 81, 439/82, 406, 845, 849, 850, 853, 55

[56] References Cited

U.S. PATENT DOCUMENTS

| | | | |
|---|---|---|---|
| 2,741,751 | 4/1956 | Weiler | 439/82 X |
| 2,869,107 | 1/1959 | Engel | 439/82 |
| 3,154,281 | 2/1962 | Frank | 439/366 |
| 3,270,251 | 8/1966 | Evans | 435/80 X |
| 3,383,638 | 5/1968 | Coldren | 439/82 |
| 3,550,069 | 12/1970 | Teagno | 439/849 |
| 4,377,321 | 3/1983 | Weisenburger | 439/406 X |
| 4,423,921 | 1/1984 | Hall | 439/849 |
| 4,790,764 | 12/1988 | Kawaguchi et al. | 439/78 |

FOREIGN PATENT DOCUMENTS

| | | | |
|---|---|---|---|
| 1142015 | 3/1963 | Fed. Rep. of Germany | 29/832 |
| 2422538 | 11/1974 | Fed. Rep. of Germany | 439/78 |
| 3006673 | 8/1981 | Fed. Rep. of Germany | 29/832 |
| 825697 | 4/1958 | United Kingdom . | |

*Primary Examiner*—William Briggs

*Attorney, Agent, or Firm*—Gregory A. Bruns

[57] ABSTRACT

A printed wiring board connector which mechanically supports the board. A connector base has legs which extend away from ends of the base and terminate in stakes which penetrate the board for attachment and electrical connection. Walls extend from the base, arch over the base, and terminate above the base. A conductive protrusion extending from a mounted electrical device is secured between the free ends of the walls and the base providing both support of the printed wiring board and electrical connection.

7 Claims, 2 Drawing Sheets

PRINTED WIRING BOARD CONNECTOR

BACKGROUND OF THE INVENTION

The invention disclosed herein relates generally to connectors for making both a mechanical and electrical connection and particularly to connectors for mechanically supporting a printed wiring board which is associated with another electrical device. For example, devices such as electromechanical relays or the like are widely used in a variety of applications. The relay design commonly provides for a method of mounting the relay. The desired operation of the relay may require that electronic circuits be provided. The electronic circuit will often be implemented using a printed wiring board (PWB). A method must then be devised for mechanically mounting the PWB; preferably the PWB will be near the relay. Then a method for making an electrical connection between the PWB and the relay must be provided.

The present invention is directed toward a simple connector that will perform the mechanical support for the PWB and will also provide the electrical connection to the electronic circuitry of the PWB.

SUMMARY OF THE INVENTION

The present invention is a connector for mechanically supporting a printed wiring board and electrically connecting the board to an electrical device. Conductive protrusions from the electrical device are secured to a conductive portion or base of the connector by the free ends of resilient arcuate section walls formed integrally with the base. Legs integral to the base extend from the base and include stakes for penetrating the printed wiring board for both attaching the connector to the board and electrically connecting the connector to the board.

DESCRIPTION OF THE PREFERRED EMBODIMENT

Figure 1:
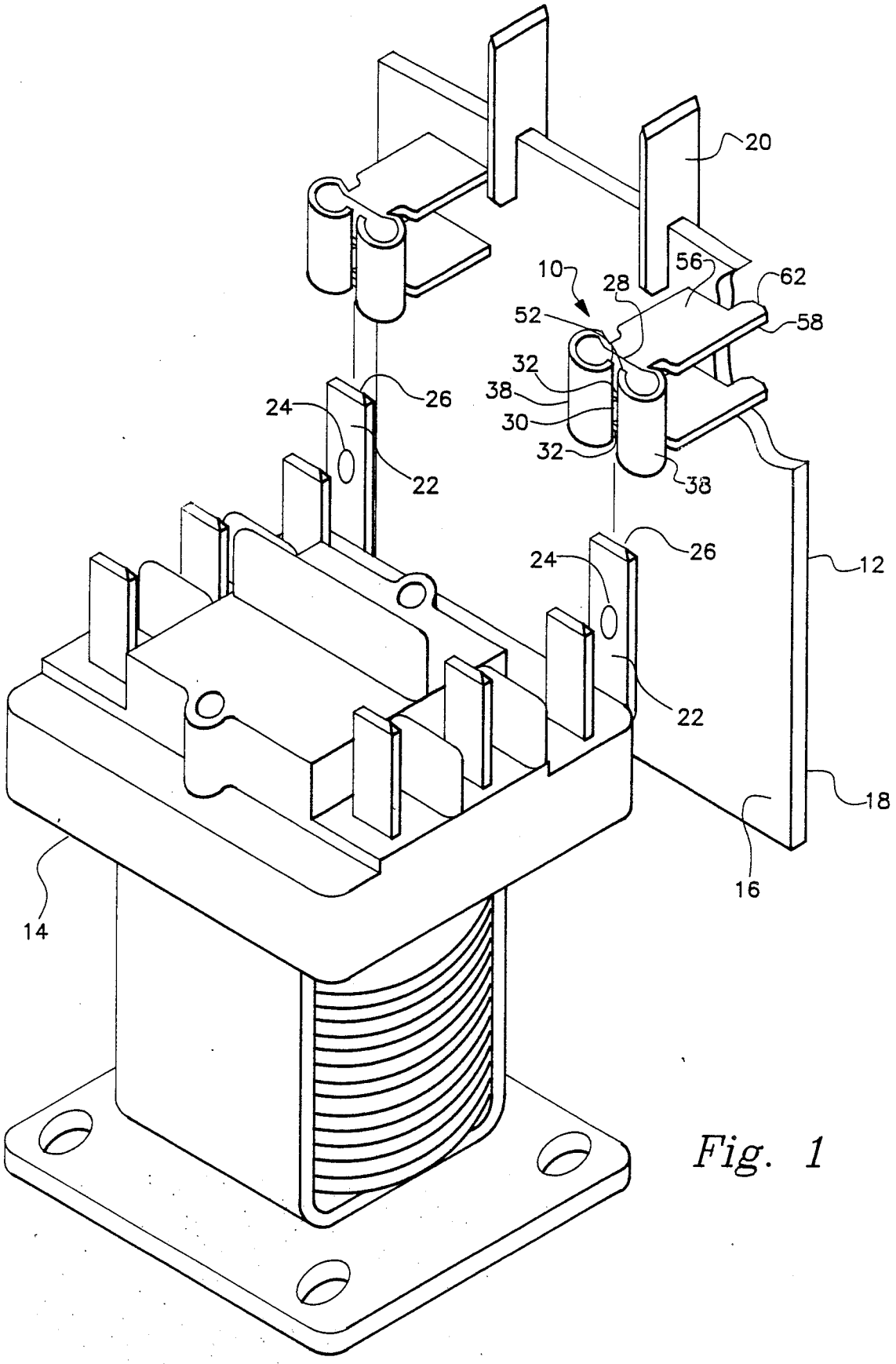
FIG. 1 is a perspective view of a connector for attaching a printed wiring board to an electrical device in accordance with the invention with the electrical device and the printed wiring board shown in an exploded view and a portion of the printed wiring board broken away.
Figure 2:
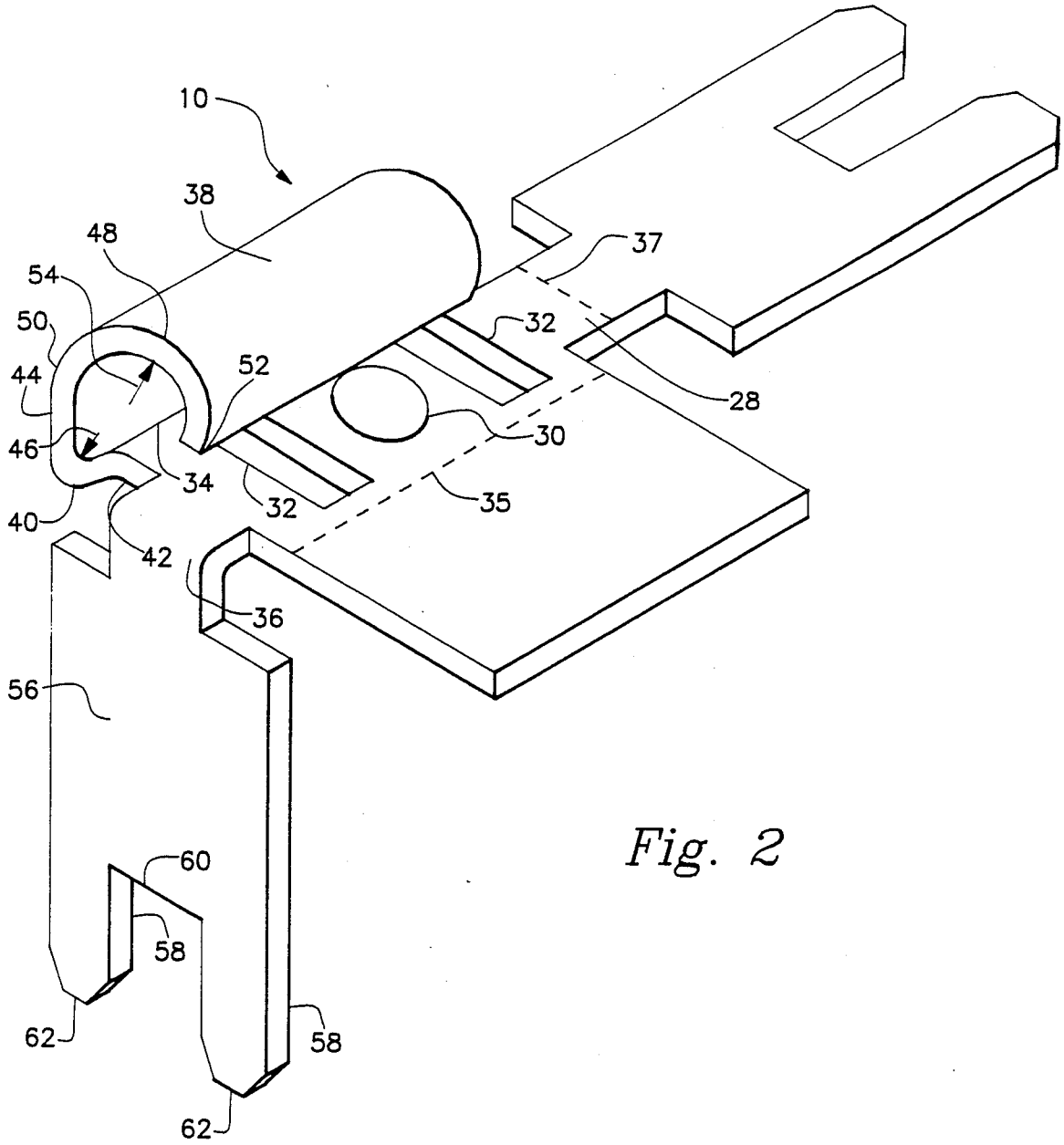
FIG. 2 is an enlarged perspective view illustrating the formation of a connector in accordance with the invention.

In FIGS. 1 and 2, reference numeral 10 identifies a connector in accordance with the invention.

As best seen in FIG. 1, connector 10 is for use in both mechanically supporting and electrically connecting a printed wiring board 12 to an electrical device 14. Printed wiring board 12 has a first surface 16 and a second surface 18. Typically discrete electronic components would be located on surface 16, and circuit paths would be located on surface 18. Printed wiring board 12 may also include terminals 20 for electrical connection to a source of electrical energy or to another circuit.

Electrical device 14 may be a variety of different types of electrical or electromechanical devices. Electrical device 14 uses conductive protrusions 22 for making the electrical connection to device 14. Protrusions 22 are male electrical terminals sometimes referred to as quick connect terminals. Protrusions 22 are generally flat and include holes 24 and tapered ends 26.

FIG. 2 illustrates the formation of connector 10 from a sheet of electrically conductive material 28. As shown in FIG. 2, connector 10 includes a conductive portion or base 28 having an edge 34, an opposite edge fold line 35, an end 36, and an opposite end fold line 37.

Wall 38 includes a first arcuate section 40 having a first end 42, a second end 44, and a radius 46. First arcuate section 40 extends generally outwardly from base edge 34 with a first portion of arcuate section extending downwardly and a second portion of the arcuate section extending upwardly. Wall 38 further includes a second arcuate section 48 having first end 50, second end or free end 52, and radius 54. First end 50 of second arcuate section 48 extends continuously from second end 44 of first arcuate section 40 with a first portion of second arcuate section 48 extending generally upwardly and a second portion of second arcuate section 48 extending generally downwardly. Radius 54 is larger than radius 46 of first arcuate section 40, and generally radius 54 is a multiple of radius 46. Connector 10 also includes an opposite wall 38 extending from the opposite edge of base 28.

Connector 10 further includes legs 56 which extend away from base 28 in a direction opposite to that of wall 38. Legs 56 terminate in stakes 58 separated by an edge 60. Stakes 58 have tapered ends 62.

Attachment of connector 10 to board 12 may be accomplished by stakes 58 penetrating board 12 with edge 60 abutting first surface 16 of board 12. Solder may then be applied to the portion of stakes 58 extending from second surface 18 of board 12. The use of solder will further secure connector 10 and is also used for electrical connection of connector 10 to circuit paths on surface 18 of board 12.

The operation of device 10 is best illustrated in FIG. 1 where two connectors are shown attached to printed wiring board 12 with the connectors spaced to approximately equal the spacing of protrusions 22 on electrical device 14. Board 12 may then be held with tapered ends 26 of protrusions 22 positioned to slide between the base or conductive portion 28 and free ends 52 of each of the connectors. The sliding placement of protrusion 22 will force ends 52 away from base 28, and ends 52 will exert a resilient force on protrusion 22 which will secure protrusion 22 against base 28.

Detent 30 will fit into hole 24 of protrusion 22 to further secure protrusion 22 to connector 10. Slots 32 in base 28 will provide some additional flexibility to the portion of base 28 that surrounds detent 30. This flexibility will allow easier insertion of protrusion 22 between ends 52 and base 28, and when detent 30 is positioned coincident with hole 24, then detent 30 will snap into hole 24 to further secure protrusion 22 within connector 10.

In accordance with the foregoing description, a simple connector has been developed that will provide mechanical support for a PWB near an electrical device and will also provide electrical connection between the PWB and the device.

The embodiments of the invention in which an exclusive property or right is claimed are defined as follows:

1. A connector for mechanically supporting a printed wiring board and electrically connecting said board to an electrical device having at least one conductive protrusion having a width, comprising:

a conductive base having first and second edges spaced apart, and first and second ends spaced apart;

means for removably securing the protrusion to said base; with said width flatly against said base;

a first leg extending away from said first end and having a stake for penetrating said board, said first leg further having an edge parallel to said first end for abutting said board; and a second leg extending from said second end and having a stake for penetrating said board, said second leg further having an edge abutting said board, said abutting edge of said second leg spaced from and parallel to said abutting edge of said first leg, said first and second legs rigidly supporting the board in a spaced relationship to the conductive protrusion with said width of said conductive protrusion parallel to said board.

2. The connector of claim 1 wherein said means for removably securing the protrusion to said conductive portion comprises:

walls extending from said first and second edges and arching over said base with said walls terminating in free ends spaced from said base, said protrusion being inserted between said free ends and said base with said protrusion forcing said free ends away from said base with said free ends exorting a resilient force on said protrusion to secure said protrusion to said base.

3. The connector of claim 2 wherein said protrusion includes a hole and said base includes a detent, said detent fitting within said hole to further secure said protrusion to said conductive portion; and said base includes at least one slot to provide flexibility to said base to allow displacement of said detent when said protrusion is inserted between said free end and said base.

4. A connector for mechanically supporting a printed wiring board and electrically connecting said board to an electrical device, the device having at least one terminal having a width, the connector comprising:

a conductive base having first and second edges spaced apart, and first and second ends spaced apart;

means for removably securing the terminal to said base with said width flatly against said base;

a first leg integral to said base, said first leg formed by folding said first leg to extend perpendicularly away from said first edge, said first leg terminating in a stake for penetrating said board;

a second leg integral to said base, said second leg formed by folding said second leg to extend perpendicularly away from said second edge, said second leg terminating in a stake for penetrating said board, said first and second legs rigidly supporting the board with said board spaced from and parallel to said width of said conductive terminal.

5. The conductor of claim 4 wherein said means for removably securing the terminal to said base comprises:

walls integral to said base and extending from said first and second edges, said walls formed by bending said walls to arch over said base with said walls terminating in free ends spaced from said base with said terminal being inserted between said free ends and said base with said free ends exerting a resilient force on the terminal to secure the terminal to the base.

6. A connector for mechanically supporting a printed wiring board and electrically connecting said board to an electrical device having at least one terminal having a width, the connector comprising:

a generally "U" shaped member having a base, a first leg and a second leg, said base having a first end and a second end spaced apart;

means for removably securing the terminal of the electrical device to said base with said width of said terminal held flatly against said base;

a planar first leg extending perpendicularly from said first end, said first leg terminating in a stake for penetrating said board, said first leg including an edge parallel to said first end, said edge abutting said board; and a planar second leg extending perpendicularly from said second end, said second leg terminating in a stake for penetrating said board, said second leg including an edge parallel to said second end, said edge abutting said board; and said first and second legs supporting the board in a spaced relationship to the terminal with said width of said terminal parallel to said board.

7. The connector of claim 6 wherein said means for removably securing said terminal to said base comprises:

first and second portions extending from said base, arching over said base and terminating in free ends spaced from said base, with the terminal being inserted between said free ends and said base, with said free ends exerting a resilient force to hold said terminal flatly against said base.

* * * * *